US005559304A

United States Patent [19]

Schweiger et al.

[11] Patent Number: 5,559,304

[45] Date of Patent: Sep. 24, 1996

[54] INSERT FOR A WARHEAD

[75] Inventors: Raimund Schweiger, Duesseldorf; Herbert Scholles, Meerbusch; Hans Orth; Hendrik Lips, both of Duesseldorf, all of Germany

[73] Assignee: Rheinmetall GmbH, Dusseldorf, Germany

[21] Appl. No.: 901,064

[22] Filed: Aug. 11, 1986

[30] Foreign Application Priority Data

Aug. 16, 1985 [DE] Germany ..... 35 29 405.1

[51] Int. Cl.[6] ..... F42B 12/10

[52] U.S. Cl. ..... 102/501; 102/476

[58] Field of Search ..... 102/306–310, 102/476, 501

[56] References Cited

U.S. PATENT DOCUMENTS

| | | | |
|---|---|---|---|
| 3,695,141 | 10/1972 | Kronman et al. | 102/501 |
| 3,732,816 | 5/1973 | Muller | 102/306 |
| 3,913,488 | 10/1975 | Dunetz et al. | 102/501 |
| 4,220,687 | 9/1980 | Christopher | 102/306 |
| 4,590,861 | 5/1986 | Bugiel | 102/476 |

FOREIGN PATENT DOCUMENTS

| | | |
|---|---|---|
| 0125573 | 5/1984 | European Pat. Off. . |
| 1328233 | 9/1969 | United Kingdom . |
| 2116298 | 9/1983 | United Kingdom . |

OTHER PUBLICATIONS

Examiner's Report to Controller.

*Primary Examiner*—Harold J. Tudor
*Attorney, Agent, or Firm*—Spencer & Frank

[57] ABSTRACT

The invention relates to an insert for a warhead for producing a projectile by means of an explosive deformation of the insert.

In order to achieve increased end-ballistic performances of the projectile formed by the explosive deformation of the insert, such insert is tapered at its peripheral region and has a flattened central region on the convex side thereof.

5 Claims, 2 Drawing Sheets

INSERT FOR A WARHEAD

BACKGROUND OF THE INVENTION

U.S. Pat. No. 4,356,770 discloses overflying munition device and system in which an insert is mounted within a warhead, which insert is formed as a spherical calotte. By means of an explosive deformation this spherical calotte is transformed into a rod-shaped projectile, which, however, due to its aerodynamically unfavorable configuration has unstable flight characteristics, a very high velocity deceleration and consequently an unfavorable end-ballistic performance. The unstable flight characteristics of such projectile lead at least to a very disadvantageous oscillation during flight, but in certain cases to a rotation of the rod-shaped projectile about a transverse axis. The high velocity deceleration can be traced to the unfavorable nose point configuration, that is, its hemispherical shape.

SUMMARY OF THE INVENTION

It is an object of this invention to provide an improved insert for a warhead which, by means of explosive deformation produces a projectile with increased end-ballistic performance.

BRIEF DESCRIPTION OF THE DRAWINGS

Advantageous embodiments of warheads comprising this invention are illustrated in the accompanying drawings. Objects and advantages will be described in the following description, which taken with the drawings, presents in a non-limiting explanation, various embodiments of inserts of the invention which are particularly well adapted for use with warheads.

DETAILED DESCRIPTION

Figure 1:
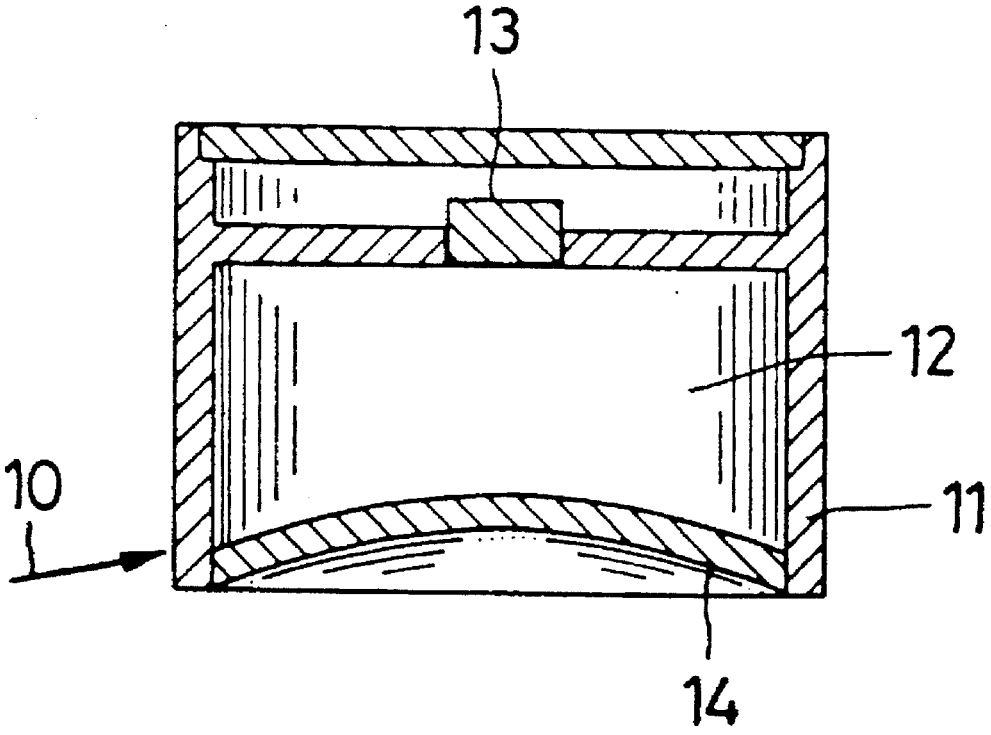
FIG. 1 illustrates in longitudinal section a conventional warhead with an insert.
Figure 2A:
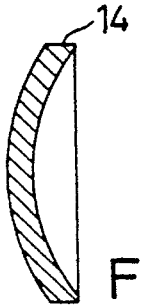
FIG. 2*a* illustrates a cross-sectional view through a conventional insert.
Figure 2B:
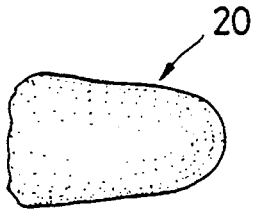
FIG. 2*b* illustrates a side elevational view of a projectile which has been formed by means of explosive deformation from an insert of the type illustrated in FIG. 2*a;*

FIG. 1 illustrates a warhead 10 of hollow cylindrical configuration, in the housing 11 of which there is disposed an explosive charge 12 adapted to be ignited by a fuse 13. The explosive charge 12 is confined at one of its end by a calotte-shaped insert 14, which is transformed into a projectile by means of an explosive deformation. In the conventional warhead, the insert 14 has a configuration of a spherical calotte as illustrated in FIG. 2*a*. Such insert of the state of the art is generally made of ductile material, such as for example copper or tantalum. This conventional insert is generally of a spherical cup shape and is delimited by a pair of surfaces of equal curvature. Such an insert 14 can be converted into a projectile 20, having a schematically illustrated rod-shape, by explosive deformation after ignition of the explosive charge 2. The rod-shaped projectile is illustrated in FIG. 2*b*. The so produced rod-shaped projectile 20 has been found to have an insufficient end-ballistic performance. The rod-shaped projectile 20 exhibits, first of all, an unstable flight characteristic during which it undergoes oscillation and even tends to rotate abut a transverse axis with respect to the direction of flight. In addition thereto, strong velocity deceleration of such projectile has been observed, which can be attributed to the unfavorable aerodynamic profile of the nose point of the projectile 20. All of this can be traced to the fact that the conventional insert 14 as illustrated in FIG. 2*a,* is explosively deformed into a rod-shaped projectile 20 with a point in the shape of a hemisphere.

FIG. 3 illustrates an insert the peripheral region of which is tapered on the exterior side thereof, which is initially subjected to air-streaming or on the opposite side which confronts the explosive material (see FIG. 1) or on both sides.

The tapering of the outer periphery of such insert leads to, when compared to an insert of substantially the same dimensions, a projectile 30 by explosive deformation, which has a tail region 30*b* which progressively decreases in diameter forwardly via a conical surface into the rod-shaped projectile portion 30*a*. This conically shaped tail 30*b* contributes to a flight stabilization of the projectile 30 so that it is assured that the projectile does indeed impinge and impact with its point or nose onto the target. However, the projectile 30 still has a nose region of disadvantageous shape, that is, in the form of a hemisphere, which causes a relative large air resistance (drag) and therefore in particular in the initial phase of the flight contributes to a pronounced velocity deceleration of the projectile 30.

Figure 3B:
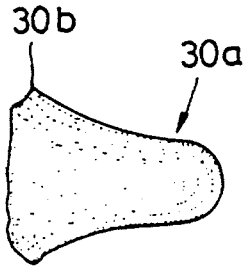
FIG. 3*b* is a side elevational view of a projectile produced by means of explosive deformation form an insert of the type illustrated in FIG. 3*a;*
Figure 4A:
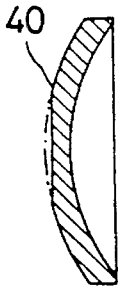
FIG. 4*a* is a cross-sectional view of an insert having a flattened central region.
Figure 4B:
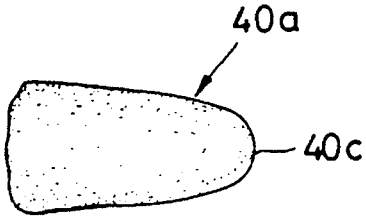
FIG. 4*b* is a side elevational view of a projectile produced by means of an explosive deformation from an insert of the type illustrated in FIG. 4*a;*

In FIG. 4*a* there is illustrated an insert 40 which has a flattened outer surface. This flattened region leads, at explosive deformation of the insert 40 to a projectile 40*a,* which in comparison to the projectile 20, produced from the insert 14 by explosive deformation in accordance with FIG. 2*a,* has a length increase of 10 to 15% and has a substantially ogival-shaped projectile nose 40*c*. This ogival nose region produces a substantially reduced velocity deceleration compared to a nose region such as that of projectiles 20 and 30*a* according to FIGS. 2*b* and 3*b*. Therefore, this "stretched" projectile shape can be considered as having more favorable end-ballistic characteristics than the projectiles of FIGS. 2*b* and 3*b*.

Figure 3A:
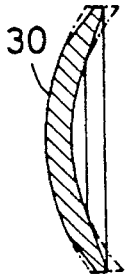
FIG. 3*a* is a cross-sectional view of an insert which is tapered at its periphery.
Figure 5A:
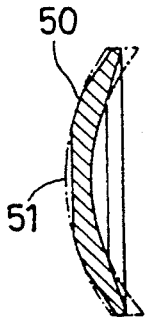
FIG. 5*a* is a cross-sectional view of an insert having a tapered peripheral region a and a flattened central region.
Figure 5B:
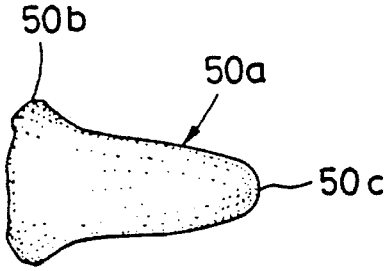
FIG. 5*b* is a side-elevational view of a projectile produced by explosive deformation from an insert of the type illustrated in FIG. 5*a.*

Finally, FIG. 5*a* illustrates an insert 50, which incorporates the features of the inserts of FIGS. 3*a* and 4*a* in one and the same insert. Thus, the insert 50 has tapered edges at its peripheral region either on the explosive charge side or on the air streaming side or on both sides, and in addition thereto has a central flattened region 51 on the convex side thereof. By means of an explosive deformation, there is produced a projectile 5*a* such as the one illustrated in FIG. 5*b*. Such projectile has an ogival nose region 50*c* and conically shaped tail 50*b*. Such a projectile has a pronounced reduced velocity deceleration during its flight. Both the nose region and the tail favor a more stable flight of the projectile 5*a* with relatively reduced velocity deceleration and therefore lead to a substantially improved end-ballistic performance. Experimentation of various shapes of inserts has brought out the fact that inserts having a tapered angle, that is, that ranges from 2° to 10° achieve very good results, whereby the tapered region extends over an angle of 15° to 25°, and preferably 20° of the radius of the insert. The flattened central region 51 of the insert 50 was selected in such a way that the thickness of the material of the insert 40 in the central region of the flattened surface 51 was reduced by 10–15% with respect to the non-flattened region of the insert 50.

Although the invention is described and illustrated with reference to a plurality of embodiments thereof, it is to be expressly understood that it is no way limited to the disclosure of such preferred embodiments but is capable of numerous modifications within the scope of the appended claims.

We claim:

1. An improved insert for a warhead for producing a projectile by explosive deformation, said warhead comprising a housing containing an explosive charge and said insert forming part of said housing and having an exterior surface which is exposed to the streaming air during flight of said warhead and having an interior surface confronting said explosive charge of said warhead, said insert having an outer peripheral tapered region with an angle of taper, said insert is calotte-shaped, said interior surface of said insert is convex and includes a central flat surface region, said outer peripheral tapered region has a tapered inner surface and a tapered outer surface.

2. The improved insert for a warhead as defined in claim 1, wherein said calotte-shape has a predetermined uniform curvature, said tapered region extends from the outer edge of said insert towards the center thereof over an angle varying from 15 degrees to 25 degrees.

3. The improved insert for a warhead as defined in claim 1, wherein said tapered region extends over an angle of 20 degrees.

4. The improved insert for a warhead as defined in claim 1, wherein the thickness of the insert at the central flat surface is reduced by 10% to 15% relative to the thickness of the insert outside of said control flat surface.

5. The improved insert for a warhead as defined in claim 1, wherein said calotte-shape is rotational and symmetrical about its longitudinal axis.

* * * * *